US005488213A

United States Patent [19]

Dittrich

[11] Patent Number: 5,488,213

[45] Date of Patent: Jan. 30, 1996

[54] LOW-PROFILE KEYBOARD KEY

[75] Inventor: Jörg Dittrich, Ammerthal, Germany

[73] Assignee: Cherry Mikroschalter GmbH, Auerbach, Germany

[21] Appl. No.: 232,205

[22] PCT Filed: Sep. 23, 1992

[86] PCT No.: PCT/EP92/02205

§ 371 Date: Jun. 15, 1994

§ 102(e) Date: Jun. 15, 1994

[87] PCT Pub. No.: WO93/10546

PCT Pub. Date: May 27, 1993

[30] Foreign Application Priority Data

Nov. 21, 1991 [DE] Germany ..... 41 38 339.7
Feb. 4, 1992 [DE] Germany ..... 42 03 120.6

[51] Int. Cl.[6] ..... H01H 3/42

[52] U.S. Cl. ..... 200/533; 200/535

[58] Field of Search ..... 200/533, 534, 200/535, 542, 545, 546, 551

[56] References Cited

U.S. PATENT DOCUMENTS 1,006,394 10/1911 Morrell ..... 200/534
3,770,923 11/1973 Habecker ..... 200/535 X
3,912,894 10/1975 Mullen et al. ..... 200/533
4,600,819 7/1986 Twyford ..... 200/542 X

FOREIGN PATENT DOCUMENTS 0028000 5/1981 European Pat. Off. ..... 200/533

*Primary Examiner*—Renee S. Luebke
*Attorney, Agent, or Firm*—Klaus J. Bach

[57] ABSTRACT

A key switch which is particularly suitable for low profile keyboards includes a plunger whose contacting movement is converted by means of trigger cams into a movement perpendicularly to the plunger movement for switching a contactor which is movable relative to a stationary contact element, the contactor being formed as annular sheet metal part which is elongate in a direction normal to the switching movement and due to its length can accommodate relatively high stress without material fatigue.

12 Claims, 5 Drawing Sheets

LOW-PROFILE KEYBOARD KEY

BACKGROUND OF THE INVENTION

The invention relates to a keyboard switch for low-profile keyboard equipment, and is a 371 filing of PCT/EP92/02205 filed Sep. 23, 1992.

The industry is making increasing efforts to miniaturize electronic apparatuses for general use. To be emphasized in particular are electronic notebooks, and computers in briefcase size, so-called laptops. With such apparatuses, in particular a low overall height is desirable. For this reason, in particular in the two uses mentioned, the key switches must be made especially flat. Industry therefore demands key switches with low overall height.

For the technical implementation of this demand several possibilities exist. The socalled membrane switch arrays can be made for example particularly flat because the key stroke necessary for contacting is itself only fractions of millimeters.

The small stroke is however a disadvantage with regard to reliability. A further disadvantage of membrane switch arrays is the low flexibility. The key switch arrangement must be defined for each product and cannot be used for other products. This therefore results in increased costs.

For this reason, industry is demanding a keyboard switch which can be used as individual element in a great variety of keyboards and is particularly flat.

This demand is met by a key switch according to DE-OS 3,921,632. In the latter a flexible contact element is pressed against stationary contact elements and thus establishes a conductive connection. The flexible contact element is constructed here as resilient membrane.

Such a key switch is therefore very similar in construction to the known membrane switch arrays. Both types of short stroke elements permit only a small stroke. This is disadvantageous in particular as regards the ergonomics.

In the publication "Ergonomics: Signals and controls", ISO/TC 159/SC4, issued by BSI United Kingdom, it is emphasized inter alia the ideal stroke should be 2–4 mm. Furthermore, ergonomic keyboards should exhibit a special force behaviour, that is they should require a relatively large force at the start of the operation and have a defined switch point in which the contact operation then takes place.

The requirement of a large stroke with defined profile of the operating force is contrary to the requirement of a very flat key switch unless the movement direction for the key switch actuation is mechanically uncoupled from the contact actuation. An example of this can be seen in EP 0 100 936. The key switch movement is converted into a plunger movement and into an operating direction perpendicular thereto. For deflecting the movement, cam surfaces are secured to the plunger and operate a contact perpendicularly to the plunger movement.

It is obvious when constructing a flat key switch to miniaturize the latter in accordance with EP 0 100 936, i.e. to reduce the size of the components by the same scale. This is however not readily possible. For with this particular design the flexible contact or contactor itself acts as resilient element. The spring force consequently changes on miniaturization. This means that, with a true-to-scale miniaturization, higher quality materials must be adopted if any impairment of stability and switching behaviour is to be avoided. This makes the switch element considerably more expensive.

Components which are too small also make assembly difficult so that existing assembly devices cannot readily be employed. Consequently, investments on a relatively large scale are required. The greatest disadvantage for the customer however results from the fact that, with said miniaturization, the quality of the switches cannot be retained if the switch is still to be made economically. This manifests itself above all in the number of operations because the springs break too quickly.

The problem underlying the invention is to provide a flat keyboard switch which permits the greatest possible number of operations with simultaneous flat construction and an ergonomically favorable stroke. In principle, the switch design is however also to be applicable generally to other switches.

SUMMARY OF THE INVENTION

A key switch which is particularly suitable For low-profile keyboards includes a plunger whose contacting movement is converted by means of trigger cams into a movement perpendicularly to the plunger movement for switching a contactor which is movable relative to a stationary contact element, the contactor being formed as annular sheet metal part which is elongate in a direction normal to the switching movement and due to its length can accommodate relatively high stress without material fatigue. The annular metal sheet part is arranged lying flat within the switch element so that appropriate spring forces can be obtained largely independently of the stroke selected. With a favourable configuration of the contactor the sheet metal component can also be made of varying width so that the force per unit length can be taken up non-uniformly. This makes it possible to optimize the force profile along the bent ring.

The annular sheet metal part can be further lengthened in that, in addition to the bending profile for the annular form, further bends are provided. In addition to the greater length of the annular sheet metal part, which is particularly advantageous as regards durability, this also reduces the stiffness and achieves better spring behaviour.

It is expedient for the greatest possible portion of the annular sheet metal part to take up deformations. For this reason, it is expedient to secure the holder of the sheet metal part only at a small surface area. In an advantageous further development correspondingly angled strip portions are attached to the sheet metal part.

In the keyboard switch according to the invention pressure points and switch points may be established in an ergonomically favourable manner. The pressure point is defined by the spring force of the annular sheet metal part and by the form of the switch cams. To achieve an abrupt switching operation in the switch point, stiffening corrugations are expediently formed in the annular sheet metal part by which a sudden triggering of the keyboard switch takes place when a predetermined switch travel is exceeded.

A further improvement can be achieved in that the free ends of the annular sheet metal part are bent so that terminal vanes attached to each of the two legs lie over each other.

This results in terminal vanes of double sheet width. The stiffness of the connection is thereby increased.

BRIEF DESCRIPTION OF THE DRAWINGS

Further advantages and features of the invention will be apparent from the description of examples of embodiment in conjunction with the claims and the drawings, which are not to scale and in which:

DESCRIPTION OF THE PREFERRED EMBODIMENT

Figure 1:
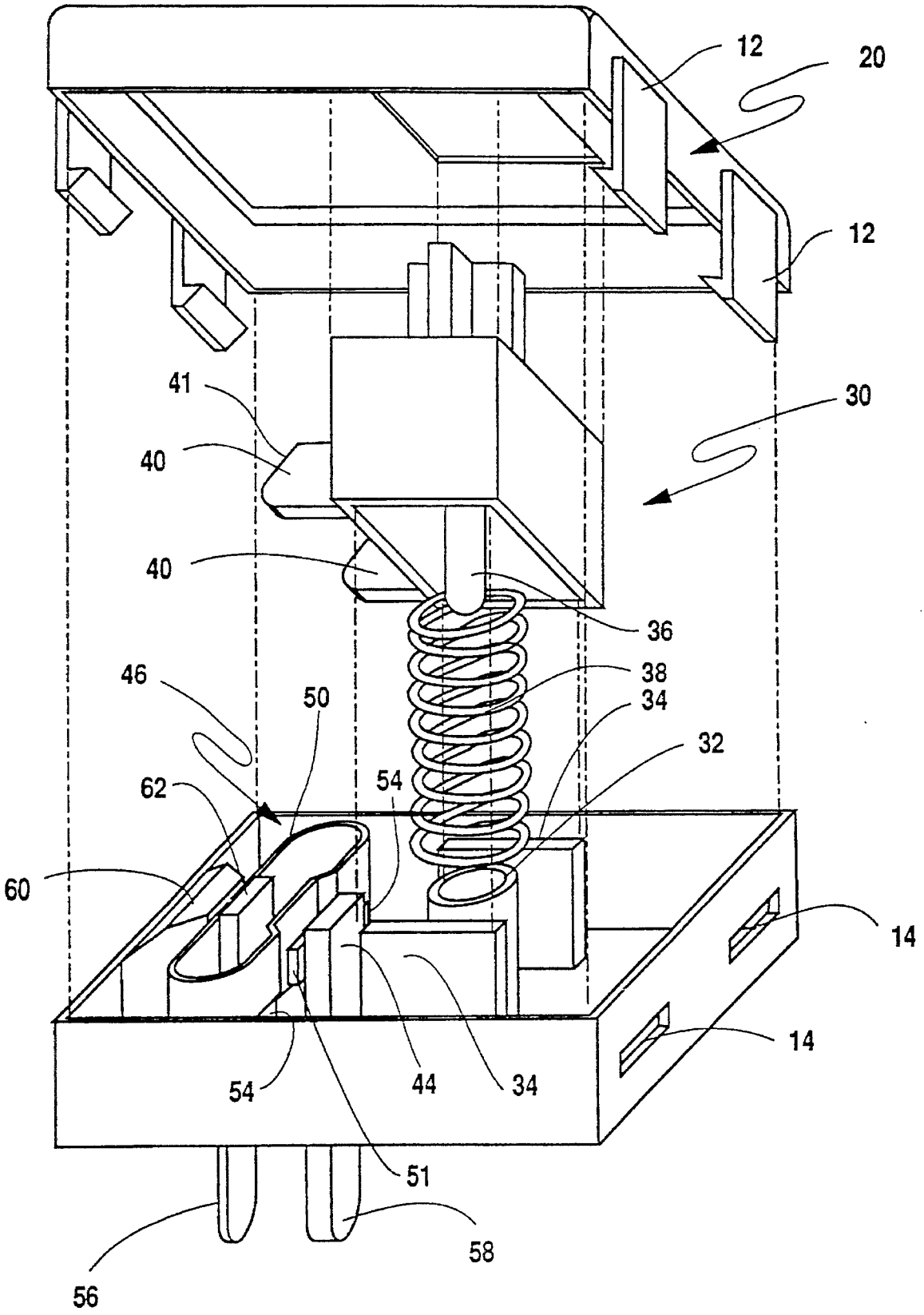
FIG. 1 shows an embodiment of a key switch according to the invention in exploded view.

A keyboard switch according to the invention as shown in FIG. 1 is mounted in a housing which consists essentially of a base 10 onto which a cover 20 is placed. Detents 12 integrally cast on the cover during the injection molding operation engage corresponding recesses or holes 14 in the base 10 and thus hold the keyboard switch together by mutual securing of base and cover. In the keyboard switch there is a movably mounted plunger 30, the movement thereof being guided by a hollow cylinder 32 accommodated in the base 10. In addition, lateral plunger guides 34 are formed on the base 10 and are received in a cavity at the lower side of the plunger 30 and both guide the latter and secure it against rotation. The guiding of the plunger by the hollow cylinder 32 in the base 10 is by means of a circular plunger element 36 which in the interior of the cavity is attached to the lower side of the plunger 30. In the cavity at the lower side of the plunger a spring 38 is accommodated which is guided by the hollow cylinder 32. The spring 38 urges the plunger 30 against the cover 20. On the plunger 30 there are two integrally molded trigger cams 40. The trigger cams serve to transmit the movement to the contact elements as required for the switching. The trigger cams 40 are therefore rounded on the side for the operation and bevelled, thereby largely defining the switching behaviour in a manner which will be described in more detail hereinafter.

The contact elements required for the contacting are mounted in the base. They consist of a stationary contact element 44 and a movable contact element or contactor 46.

According to the invention the contactor 46 is bent from a sheet metal part into an oval shape. Contact portion 51 is disposed on the annular sheet metal part 50 and together with other contact portions on the stationary contact element 44, establish the contact. The contact portion on the stationary contact element can be made spherical and thus establish good contact with the contact portion 51 on the contactor 46.

Another possibility of implementing a good contact is by two perpendicularly abutting contact portions made as sharp edges as is known to the person skilled in the art.

The oval sheet metal part 50 consists of resilient material. The resilient contactor is mounted in the base 10 and is biased with respect to the stationary contact element 44. The trigger cams 40 of the plunger engage the contactor 46 and control the movement thereof. On the oval sheet metal part recesses 54 are provided which can be made by an embossing step. These recesses 54 serve in conjunction with the trigger cams 40 to define a switching point as will be illustrated in more detail hereinafter. The contactor 46 is secured via the oval sheet metal part 50 to the base 10 by two clamping members 60 and 62 disposed in the base 10. Extensions are led out of the base 10 both from the oval sheet metal part 50 and from the stationary contact element 44 and as solder leads 56 and 58 are available for connection to electric wires or for installation into printed circuits.

The mode of operation of the key switch will become clearer from the switching behaviour illustrated in FIGS. 2 to 5. These Figures represent sections with plungers in different switching depths.

Figure 2:
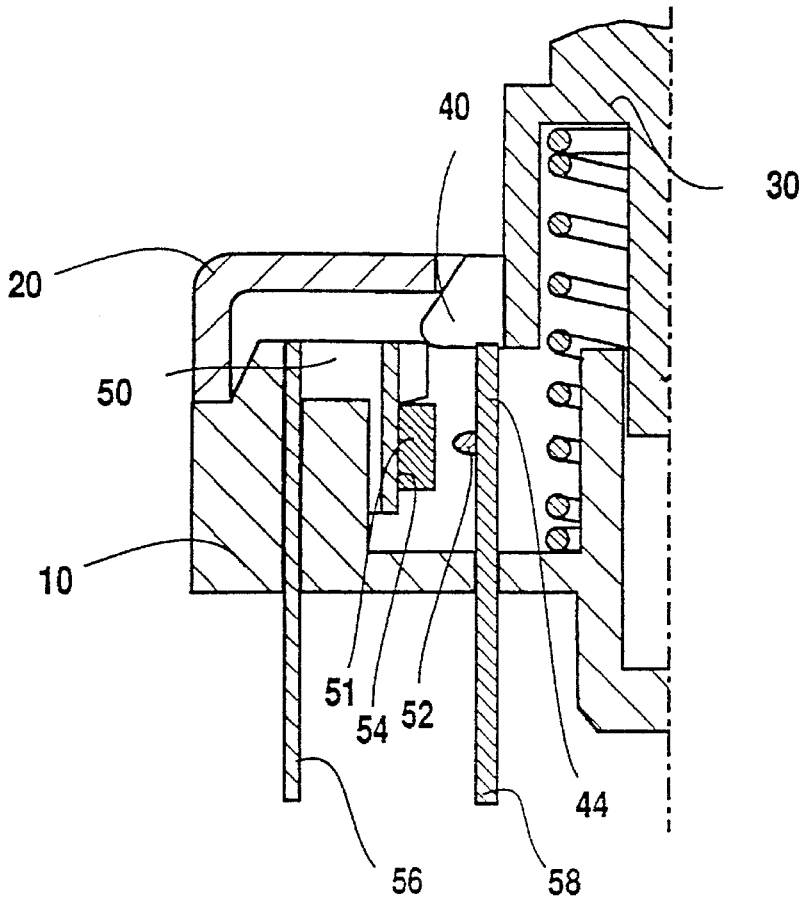
FIG. 2 shows a section through a key switch according to FIG. 1 in the rest position.

FIG. 2 shows the rest position. The cover 20 is placed on the base 10 and fixes the plunger 30 by the pressure spring on a stop (not illustrated). The trigger cam 40 bears on the oval sheet metal part 50 so that the two contact portions are held spaced apart.

Figure 3:
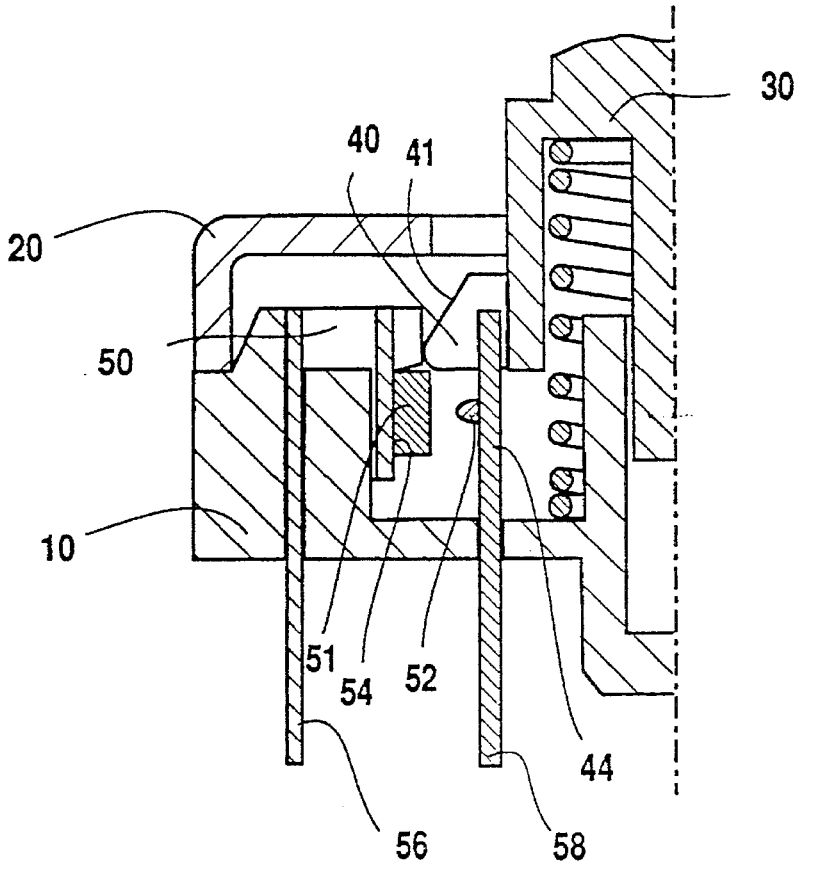
FIG. 3 shows a section through a key switch according to FIG. 1 in a switching position just before the switching point.

In FIG. 3 the plunger 30 is depressed somewhat. A comparison of FIG. 2 and FIG. 3 shows clearly that the two contact portions 51 and 52 are held further apart by the form of the trigger cam 40 in FIG. 3 than in FIG. 2. For the bending of the oval sheet metal part 50 a greater force must be applied than at the beginning of the movement so that a force gradient rising with the plunger travel results.

It can be seen from FIG. 3 that the recesses 54 provide for a sudden drop in the force.

Figure 4:
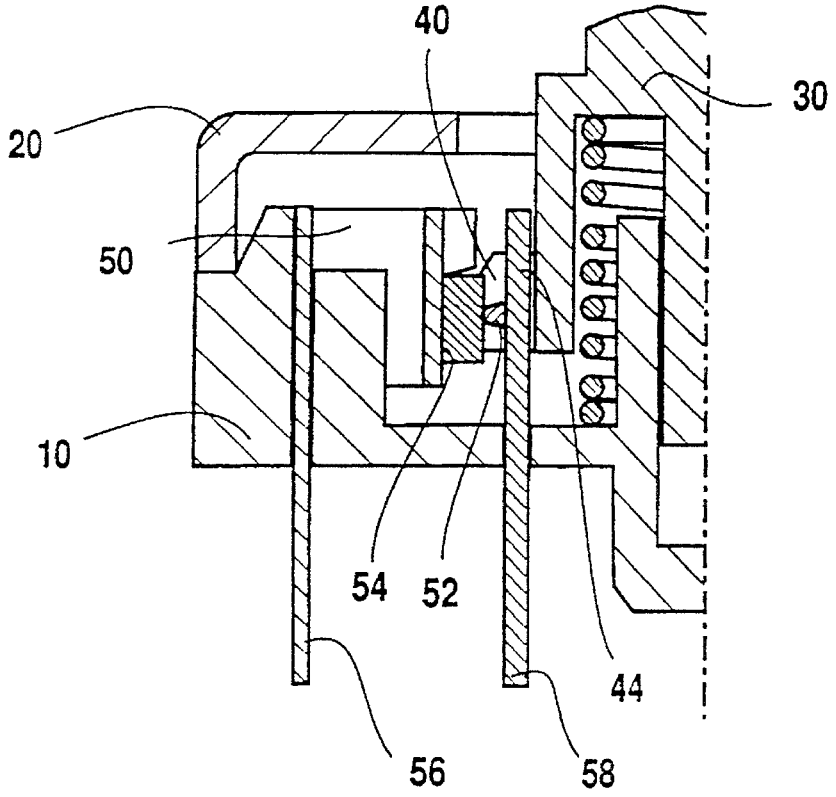
FIG. 4 shows a section through a key switch according to FIG. 1 after exceeding the switching point.

This is particularly clear in comparison with FIG. 4 where the trigger cam 40 is depressed fully into the region of the recesses 54 so that the spring force of the oval sheet metal part 50 pushes the contact portion 51 towards the contact portion 52 and presses it against the latter. An electrical contact is then established between the soldering leads 56 and 58 and a switch is closed. Thus, with this embodiment a fixed switching point is defined at which a sudden key pressure drop is also implemented in an ergonomically favourable manner.

Figure 5:
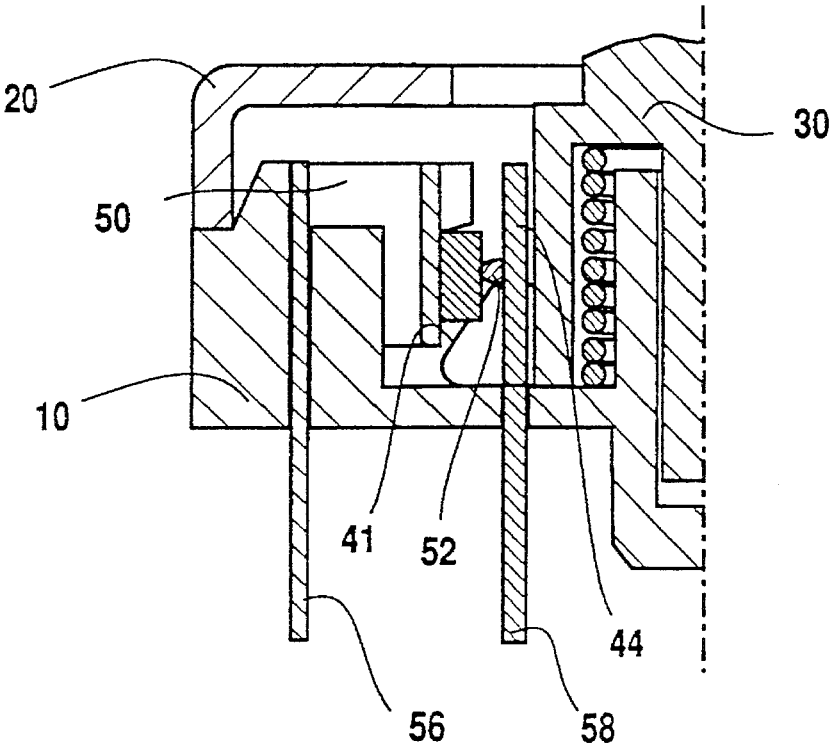
FIG. 5 shows a section through a key switch according to FIG. 1 after reaching the end position.

FIG. 5 shows the end position of the key switch operation. Since the contact 51 is now held back by the contact 52, the spring force of the oval sheet metal part does not act on the trigger cam 40 and for a return to the end position it is necessary to consider only the spring force of the spring 38. After release of the key switch the spring 38 drives the plunger 30 back into the end position according to FIG. 2, the cams 40 pressing the oval sheet metal part back via the slope 41 and the edge of the recess.

The switching operations shown in FIGS. 2 to 5 show that, with the aid of a keyboard switch according to the invention, an ergonomically favourable switching behaviour can be obtained. At the start of the plunger movement the force is increased. On overcoming the switching point the force profile is reduced and the switching operation takes place suddenly and in a defined manner at a switching point governed by the design. This switching behaviour is achieved essentially by the form of the trigger cam 40 and the recess 54. FIGS. 2 to 5 also clearly show that to implement such a switching behaviour, a certain minimum stroke is necessary. Such a behaviour, without requiring much space for the stroke, is possible only because the key action is converted with the aid of the cam 40 into a contact movement perpendicularly to the key movement. With the form of the contactor 46 according to the invention, that is due to the fact that the contact portion is disposed on a long annular sheet metal part, the forces occurring in the switching operation can be distributed over a corresponding length so that a reduced bending force acts on each surface element. As a result, it is ensured according to the invention that material fatigue is only very slight and in spite of the small and flat design several million switching operations can be reliably carried out.

In FIG. 6 a base 10 is again shown but with a somewhat different construction of the contactor 46. To utilize the entire length of the oval sheet metal part 50 for taking up the bending forces, it is expedient to employ only a minor portion of the total sheet metal part length within the base 10 for securing the contactor 46. This is solved in the example of FIG. 6 in that additional rectangular strip portions 66 are bent from the oval sheet metal part and held by clamping elements 68 and 69 in the base 10.

Figure 6:
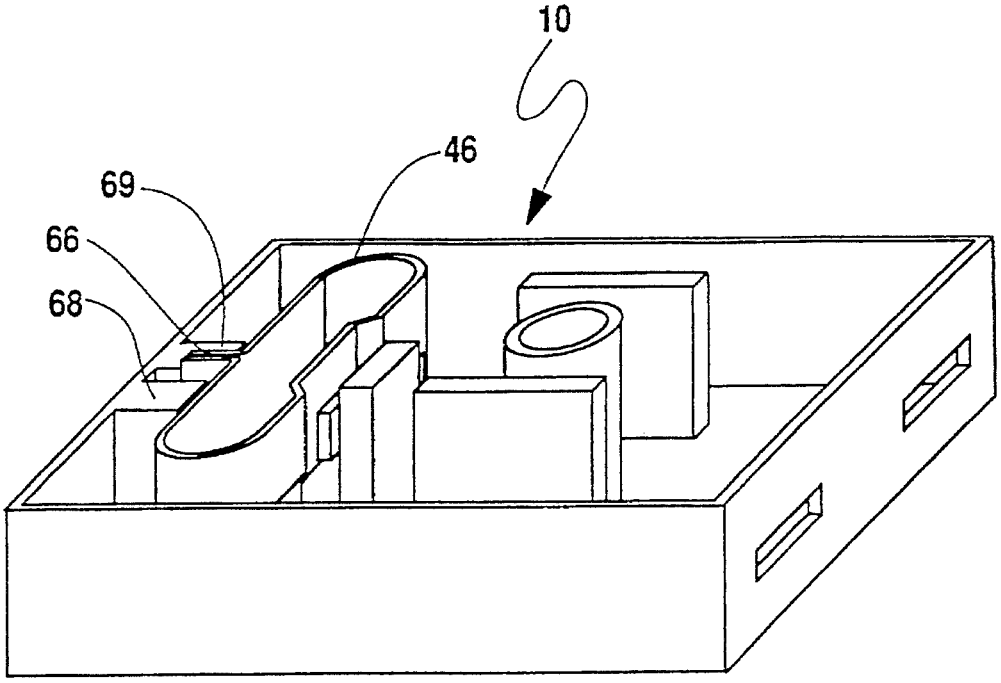
FIG. 6 shows a key switch base having a different constructional form of the annular sheet metal part according to the invention.
Figure 7:
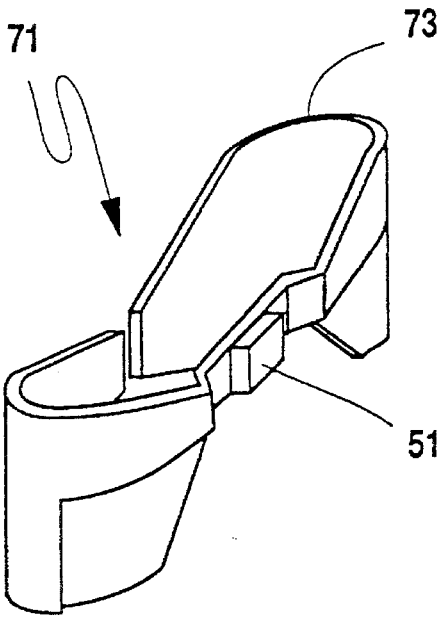
FIG. 7 shows a further embodiment of the annular sheet metal part with varying widths of the sheet metal part.

In the contactors as they have been described in conjunction with FIG. 1 and FIG. 6, a bending by the movement of the contact will manifest itself substantially in the curve portions. The straight sections of the rings shown are correspondingly rigid. To obtain a better force distribution over the entire length and to keep the material stress per unit area correspondingly small, it is expedient to modify the rigid straight connecting portions of the preceding examples. Such a modification is shown in FIG. 7. Like the previously discussed contactor 46, the contactor 71 again comprises a contact portion 51 and operates in the same manner as described above. The sheet metal piece employed to make the contactor 71 however, is wider at the rounded portions 73 and tapers towards the ends and towards the contact portion 51. These tapered regions can thereby be more easily deformed so that part of the bending and thus part of the stresses are also taken up by said tapered regions and the rounded portions 73 subjected to less load.

Figure 8:
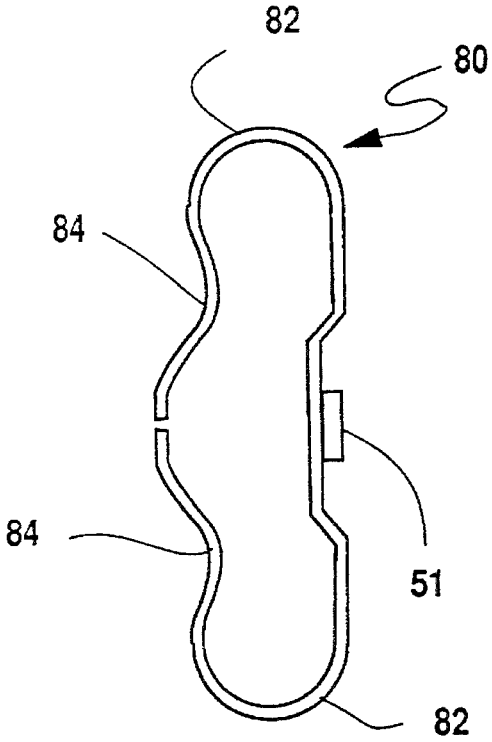
FIG. 8 is a plan view of an annularly bent sheet metal part to illustrate further possible embodiments.

In FIG. 8 another step is shown which modifies the rigid straight sections in order to take up greater forces more easily. In FIG. 8 the contactor 80 is shown in plan view. It is apparent therein that this contactor not only has the rounded portions 82 necessary for the bending but also has sections with additional rounded portions 84 which fulfill two purposes. Firstly, this increases the overall length of the sheet metal part so that less force per unit area is taken up. Secondly, this additional rounding 84 also reduces the total stiffness.

Figure 9:
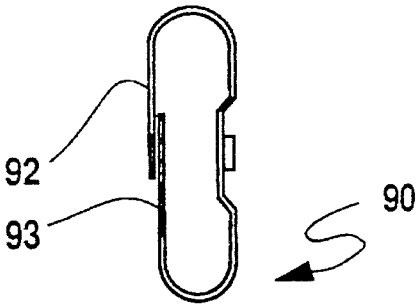
FIG. 9 is a plan view of an annular sheet metal part with overlapping legs to illustrate further improved embodiments.

In FIG. 9 a further improvement of a contactor according to the invention is shown. The contactor 90 shown in FIG. 9 has free legs 92 and 93. The oval contactor 90 is bent together in such a manner that the sheet metal part overlaps at the legs 92 and 93. As a result a larger length of the annularly bent sheet metal part is again achieved. The overlapping configuration however has another advantage. For, if vanes for the connection are provided on each leg and come to lie above each other on overlapping, this gives double the thickness of the sheet metal part 50 for the soldering lead 56 in FIG. 1. As a result, the stiffness of the soldering lead is increased compared with the embodiments described above.

Figure 10:
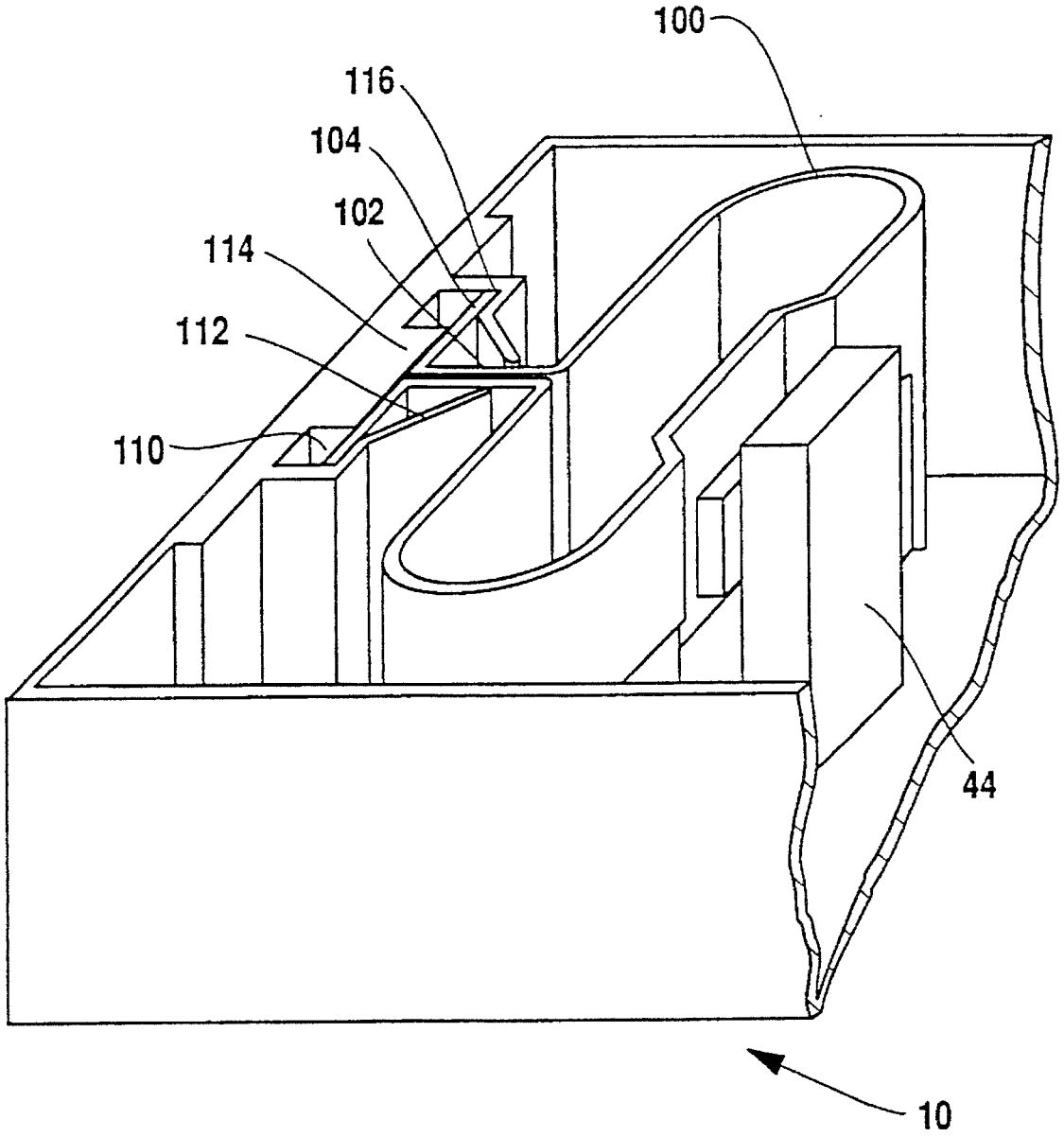
FIG. 10 shows part of a key switch base with a further embodiment of the invention.

In FIG. 10 a further embodiment of the oval sheet metal part is shown. The contactor 100 is illustrated in FIG. 10 in a part of the base 10 having a stationary contact element 44.

The spring length for taking up the forces in this example is further increased in that the oval sheet metal part 100 is bent U-shaped at each of its ends. This makes a further deformation of the oval sheet metal part 100 possible when the clamping is correspondingly configured.

In the example according to FIG. 10 each U form is obtained in that, at the ends of the oval sheet metal part, in each case a portion 102 is bent at right-angles from which in turn an end portion 104 is again bent at right-angles. The length of the spring is best utilized when such an oval sheet metal part is secured or held as far as possible towards the outside 116 within the base 10.

In accordance with FIG. 10 the oval sheet metal part 100 is inserted into the base 10 into a recess 110 from above. The recess 110 may have various forms, taking into consideration inter alia, ease of assembly. The specific configuration shown in FIG. 10 has the advantage that for taking up the forces a maximum of the possible spring length is utilized. Where a force acts on the oval sheet metal part 100 to the left according to the illustration of FIG. 10, the portions 102 are also subjected to a force component to the left. However, the sheet metal part cannot yield in this direction because the stop 114 is disposed there. The spring however also yields however, perpendicularly to the action of the force where the vanes 112 formed in the housing bear on the portions 102. The vanes 112 are yieldable and thereby resiliently take up part of the force acting.

Consequently, in this example the entire length of the spring is effective in taking up the force, except for a small portion of the end section. The load per unit area is therefore further reduced. In addition, part of the force acting is taken up by the yieldability of the vanes 112, this additionally relieving the spring.

The steps discussed above show that, with simple design measures, a better distribution of the forces acting is possible so that in this manner the life of the switch elements according to the invention can be optimized. An important factor in implementing such optimizing steps is however the existence of the greatest possible spring length of the contactor. This is possible with the contactor according to the invention, that is by the formation of the contactor as oval sheet metal part. With this embodiment of the contactor according to the invention it is therefore possible to create an ergonomically favourable keyboard with only slight load of the contactor and consequently with low material fatigue.

A further advantage according to the invention is that annularly closed contactors exhibit a greater resistance to sagging or bending in the direction of the plunger movement than do cantilevered contactors according to the prior art. This has a particularly positive effect on the switching hysteresis.

What is claimed is:

1. A mechanically operable electrical switch element comprising a plunger supported in a housing so movable in a predetermined direction for opening or closing an electrical contact formed between a stationary contact element and a movable contactor, said plunger comprising two trigger cams projecting therefrom perpendicularly to the direction of movement of the plunger for actuating the electrical contact with a movement of the contact portion of the contactor in a direction perpendicularly to the direction of movement of the plunger, said contactor consisting of a sheet metal part bent to an elongate oval shape having essentially flat opposite sides and bent opposite ends at the greatest extent thereof, said sheet metal part being disposed in a plane normal to the direction of movement of said plunger, and arranged in the switch element in such a manner that its greatest extent is also perpendicular to the direction of movement of the contact portion, and said contact element and said movable contact portion being disposed between said two trigger cams.

2. A switch element according to claim 1, wherein said ovally bent sheet metal part has an essentially uniform width.

3. A switch element according to claim 1, wherein the ovally bent sheet metal part has a non-uniform width.

4. A switch element according to claim 3, wherein regions of larger width of the ovally bent sheet metal part are provided at points of greater bend.

5. A switch element according to claim 1, wherein said ovally bent sheet metal part comprises bends in addition to the bent end areas.

6. A switch element according to claim 1, wherein said stationary electrical contact element is mounted in a base of the switch and the mounting of the ovally bent sheet metal part is effected on the flat side opposite the flat side used for the contacting.

7. A switch element according to claim 6, wherein the mounting of the ovally bent sheet metal part is effected on separate angled portions of the annularly bent sheet metal part.

8. A switch element according to claim 1, wherein the trigger cams are formed such that, on displacement of the plunger during a stroke, up to a switching point an increased operating resistance results.

9. A switch element according to claim 1, wherein the ovally bent sheet metal part includes recesses which, in cooperation with the form of the trigger cams, are shaped such that, in cooperation with said recesses, they define a switching point at which only a slight travel distance is necessary in order to effect sudden switching.

10. A switch element according to claim 1, wherein said ovally bent sheet metal part is open-ended and comprises free legs at its ends, with contact vanes formed on each leg and protruding from the housing, said free legs and said contact vanes overlapping so that a terminal formed by said contact vanes is twice as thick as the sheet metal part.

11. A switch element according to claim 1, wherein the ovally bent sheet metal part has portions bent at right angles at its ends and wherein, at the portions bent at right angles, end portions likewise bent at right angles are provided for securing the ovally bent sheet metal part in said housing.

12. A switch element according to claim 11, wherein said ovally bent sheet metal part is mounted with its end portions bent at right angles within a recess formed in said base, said base having vanes formed thereon which bear on the inserted annular sheet metal part on the portions thereof which are bent at right angles.

* * * * *